United States Patent [19]

Lane

[11] Patent Number: 4,800,689

[45] Date of Patent: Jan. 31, 1989

[54] FASCIA ASSEMBLY FOR SECURING EDGE OF RUBBER ROOF MEMBRANE INCLUDING REINFORCING CLIPS

[75] Inventor: Bennie L. Lane, Eagle, Wis.

[73] Assignee: Metal Era, Inc., Waukesha, Wis.

[21] Appl. No.: 82,736

[22] Filed: Aug. 7, 1987

[51] Int. Cl.[4] ..... E04D 1/36

[52] U.S. Cl. ..... 52/60; 52/94; 52/96

[58] Field of Search ..... 52/528, 58–60, 52/94, 96

[56] References Cited

U.S. PATENT DOCUMENTS 4,483,112 11/1984 Rueblinger ..... 52/58

4,641,476 2/1987 Webb et al. ..... 52/60

*Primary Examiner*—James L. Ridgill, Jr.

*Attorney, Agent, or Firm*—Michael, Best & Friedrich

[57] ABSTRACT

A fascia assembly for securing the edge of a rubber roof membrane to the edge of a roof, the fascia assembly including a sheet metal fascia adapted to secure the edge of the membrane against a dam, and reinforcing clips adapted to be housed within the fascia and to prevent deflection of the material of the fascia in the event of forces on the membrane tending to pull the membrane away from the dam.

10 Claims, 1 Drawing Sheet

FASCIA ASSEMBLY FOR SECURING EDGE OF RUBBER ROOF MEMBRANE INCLUDING REINFORCING CLIPS

FIELD OF THE INVENTION

The present invention relates to apparatus for use in construction of buildings and more particularly to gravel curbs employed at the edge of rubber roof membranes and for securing the edges of the membrane to the edge of the roof.

BACKGROUND PRIOR ART

In the construction of flat roofed buildings, the roofs are commonly covered with a rubber membrane, and the membranes are in turn covered with a suitable ballast such as gravel or stones. Gravel stops are provided at the edge of the roof to retain the ballast on the roof and control water drainage, and also to function as a mechanical means for securing the edges of the rubber membrane to the edges of the roof.

Examples of gravel stops or gravel curbs for use in securing the edges of a rubber membrane to the edge of a roof are illustrated in Butzen, U.S. Pat. No. 4,419,850, issued Dec. 13, 1983; Patry, U.S. Pat. No. 4,037,372, issued July 26, 1977; Hickman, U.S. Pat. No. 4,472,913, issued Sept. 25, 1984; and Benoit, U.S. Pat. No. 4,437,283, issued Mar. 20, 1984. Attention is also directed to Josek, U.S. Pat. No. 3,365,847, issued Jan. 30, 1968; German Auslegeschrift No. 17 84 213; and Hickman, U.S. Pat. No. 4,071,987, issued Feb. 7, 1978. Attention is also directed to the publication of the Single Ply Roofing Institute titled "Wind Design Guide for Ballasted Single-Ply Roofing Systems".

It is necessary that the gravel stops secure the membrane in place with a grip sufficient to withstand a force of 90 lbs. per foot of length of the edge of the membrane. Additionally, the membrane securing structure should also be constructed in a manner which facilitates low cost installation of the structure used in mechanically securing the edge of the membrane down against the gravel stop.

SUMMARY OF THE INVENTION

The present invention provides a gravel stop or gravel curb assembly having an improved construction in that it provides a high strength structure for securely gripping the edge of the rubber membrane and for restraining the rubber membrane against the forces substantially greater than those foreseeably applied to the membrane when the membrane is in use. Additionally, the gravel stop provides a structure which is conveniently and safely installed with a minimum of labor and with little skill or experience required of the workman. The apparatus embodying the invention also has a construction which permits low cost manufacture and use of relatively inexpensive raw materials.

More particularly, the invention includes a roof fascia assembly comprising a dam adapted to be secured to the edge of a roof, the dam including a first portion having a lower edge adapted to be secured to the upper surface of the roof and a vertical portion secured to the vertical surface of the edge of the roof, a lower edge of the vertical portion being below the surface of the roof and an upper portion of the vertical portion projecting above the surface of the roof, and the dam being adapted to support an edge of the membrane thereon, the edge of the membrane extending over the dam and being positioned against the outer surface of the dam. The roof fascia assembly also includes a fascia for covering at least a portion of the dam and a portion of the rubber membrane, the fascia including a vertical portion adapted to overlie the vertical portion of the dam, with the edge portion of the rubber membrane positioned between the vertical portion of the dam and the vertical portion of the fascia. The vertical portion of the fascia has a lower edge including means for engaging the lower edge of the vertical portion of the dam to restrain the fascia against upward movement with respect to the dam, and an upper portion extending over the upper edge of the dam. The roof fascia assembly also includes reinforcing clips housed within the upper portion of the fascia and providing means for reinforcing the upper portion of the fascia against deflection caused by forces on the rubber membrane.

The provision of a plurality of reinforcing clips positioned along the length of the water dam provides high strength means for securing the membrane in place while facilitating the use of a relatively light weight metal in formation of the fascia. Because the reinforcing clips are relatively rigid and provide high strength membrane retention, the fascia can be comprised of a lighter weight material than would otherwise be necessary. This facilitates manufacture of the fascia cover and also facilitates installation of the fascia assembly on the roof edge and more convenient handling of the fascia assembly materials during the installation process.

Various other features and advantages of the invention will be apparent by reference to the following description of a preferred embodiment, from the drawings and from the claims.

Figure 1:
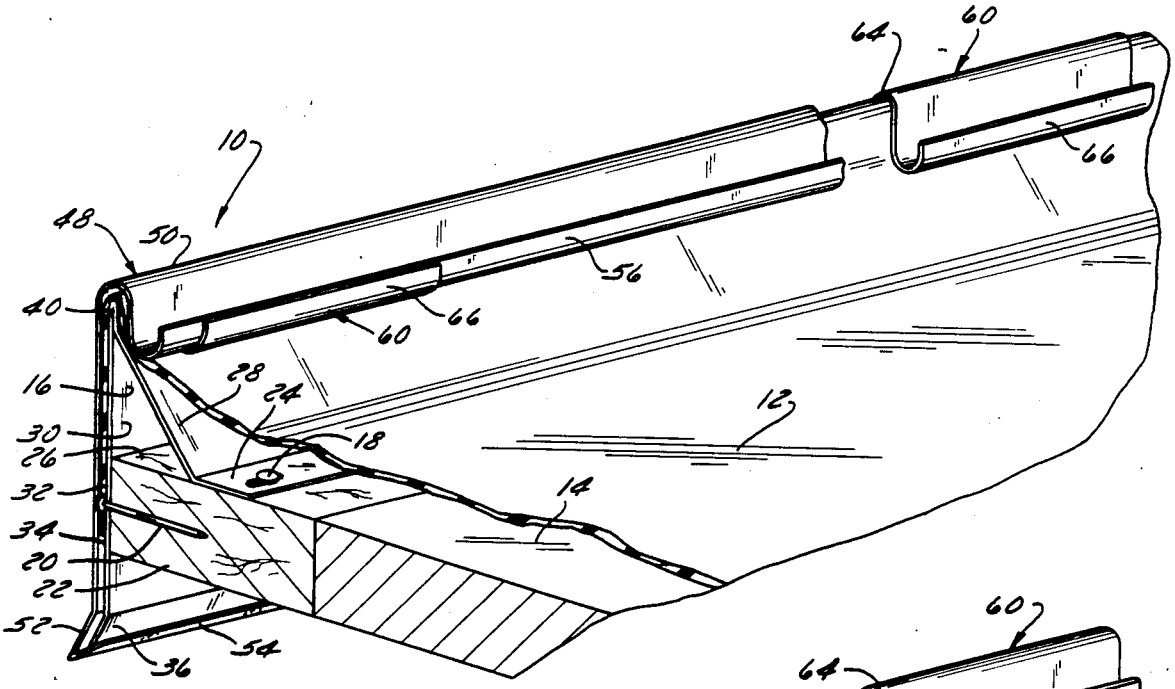
FIG. 1 is a perspective view of a fascia assembly embodying the invention and securing a rubber membrane to the surface of a roof.
Figure 2:
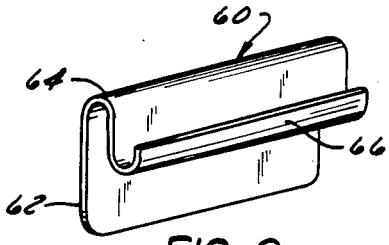
FIG. 2 is a perspective view of a reinforcing clip illustrated in FIG. 1.

Before describing a preferred embodiment of the invention in detail, it is to be understood that the invention is not limited to the details of construction and to the arrangement of the components set forth in the following description or illustrated in the drawings. The invention is capable of other embodiments and of being practiced and carried out in various ways. Also, it is to be understood that the phraseology and terminology employed herein is for the purpose of description and should not be regarded as limiting.

DESCRIPTION OF A PREFERRED EMBODIMENT

Illustrated in FIG. 1 is a gravel curb assembly 10 embodying the invention and used to secure a rubber roof membrane 12 down against the edge of the upper surface 14 of a flat roof. The gravel curb assembly 10 includes a gravel dam 16 secured by nails 18 and 20 to the wooden nailer 22 forming the edge of the roof. The gravel dam 16 includes a horizontally extending edge flange portion 24 adapted to be positioned on the upper surface 26 of the nailer 22 and secured in place by a plurality of nails 18 or other fasteners. The gravel dam 16 also includes an inclined portion 28 extending upwardly and outwardly away from the surface 14 of the roof and having an upper edge terminating generally at the vertical plane defined by the edge of the roof. The gravel dam 16 also includes a portion 30 extending downwardly from the upper edge so as to define a vertical plate having a lower portion 32 positioned against and covering the vertical surface 34 of the nailer 22. The vertical portion 30 of the gravel dam 16 extends downwardly below the nailer and includes a lower edge portion defining a lip or flange 36 included downwardly and outwardly away from the vertical surface 34 of the edge of the roof.

In the particular arrangement of the invention illustrated in the drawings, the upper edge portions of the vertical plate portion 30 and the inclined portion 28 of the gravel dam are pinched so as to form a generally flat pleat or rib 40 extending along the length of the upper edge portion of the gravel dam 16.

During installation of a rubber membrane 12 on a roof, the edge of the membrane is laid over the gravel dam 16 and is secured to the surface 14 of the roof and to the inclined surface of the gravel dam 16 by a bonding adhesive 42. A portion 44 of the edge of the membrane 12 extending over the rib 40 extends downwardly to cover the vertical wall portion 30 of the gravel dam. The edge portion 45 of the membrane and the lower portion of the vertical plate are secured to the face of the wooden nailer 22 by a nail or other fastener 20 extending through the membrane and through the vertical plate 30. In a preferred form of the invention the nails 20 are spaced apart along the length of the edge of the roof.

Figure 4:
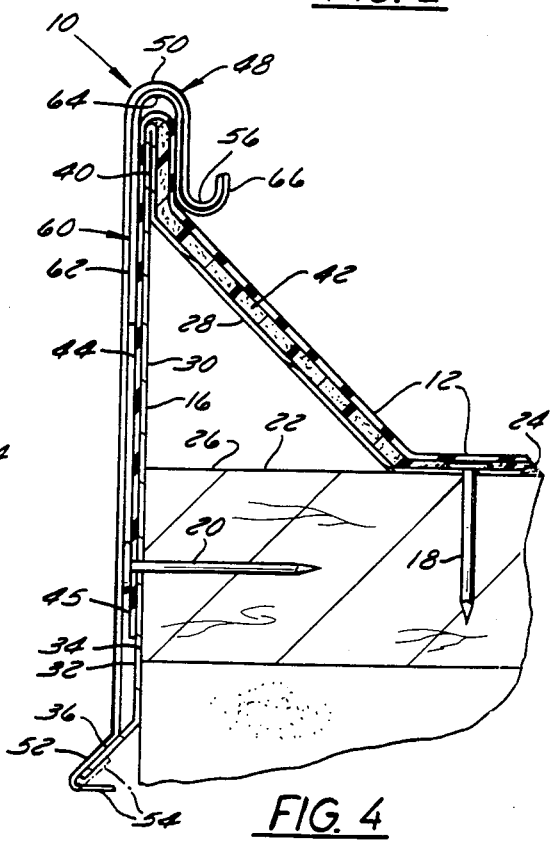
FIG. 4 is a view similar to FIG. 3 and showing the fascia cover in place.

As illustrated in FIGS. 1 and 4, a fascia or cover plate 48 is also positioned over the rubber membrane 12 and further functions to hold the membrane down against the upper surface of the roof and against the inclined surface 28 of the gravel dam 16. The fascia 48 comprises an elongated structure adapted to cover the outer portion of the rubber membrane and includes an upper edge portion 50 adapted to extend over the upper edge of the gravel dam. In the illustrated construction a lower edge portion 52 of the fascia 48 extends downwardly and outwardly complementary to the lower edge portion 36 of the gravel dam 16, and the lower edge portion 52 of the fascia 48 includes a lip 54 adapted to extend under the lower edge 36 of the gravel dam. The upper portion 50 of the fascia cover forms a smooth curve over the upper edge of the gravel dam 16 and terminates in an upwardly curved lip 56 adjacent the intersection of the inclined portion 28 of the gravel dam 16 with the vertical rib 40. The curved lip 56 defines a smooth curved surface adapted to engage the membrane 12 and hold it down against the surface of the gravel dam.

The fascia assembly 10 also includes a plurality of reinforcing clips 60 positioned in spaced relation along the length of the gravel dam 16 and adapted to secure the membrane down against the upper edge of the gravel dam 16 and to be housed within the curved upper portion 48 of the fascia to provide a relatively rigid structure to reinforce the facia and prevent deformation of the facia caused by forces on the rubber membrane. In one preferred form of the invention, the reinforcing clips 60 are comprised of a relatively rigid steel and have a configuration conforming to the curved interior surface of the upper portion 48 of the fascia cover such that the reinforcing clips 60 can nest within that upper portion of the fascia cover. More particularly, the reinforcing clip include a first planar portion 62 extending downwardly from the top portion of the gravel dam 16 and adapted secure a portion of the membrane 12 against an upper portion of the vertical portion 30 of the gravel dam 16. The reinforcing clip 60 also includes a upper curved portion 64 defining a smooth inverted U-shape curve and extending over the rib 40. In the illustrated construction the upper curved portion 64 does not engage the upper edge portion of the rubber membrane, and permits the rubber membrane to form a smooth curve over the rib 40. The reinforcing clip also includes a downwardly extending curved lip portion 66 adapted to be complementary to the interior surface the curved lip 56 of the fascia.

Figure 3:
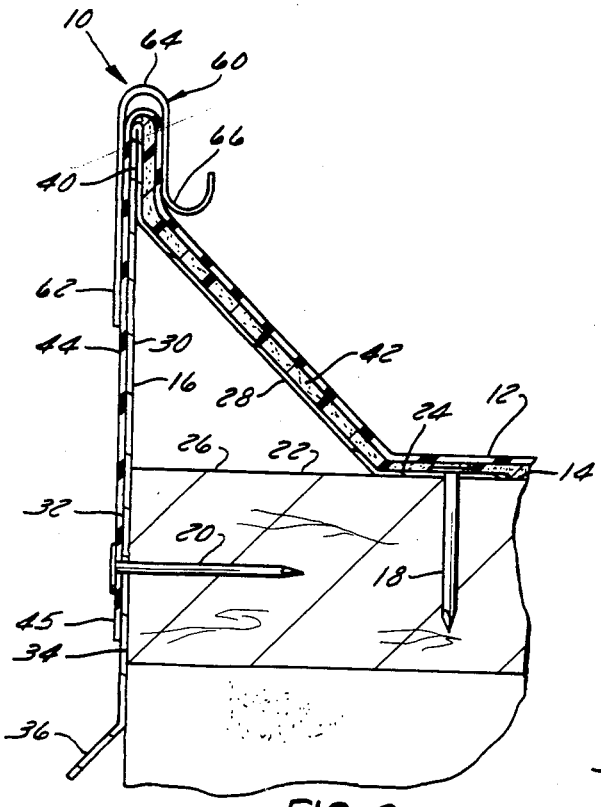
FIG. 3 is an enlarged cross-section elevation view of apparatus illustrated in FIG. 1 and with the fascia cover removed.

In installation of the rubber membrane 12, after the rubber membrane is laid over the gravel dam 16 and secured in place by adhesive and nails, spring clips 60 can be clipped over the membrane and the rib 40 of the gravel dam as illustrated in FIG. 3. The reinforcing clips 60 are spaced apart at intervals along the length of the gravel dam. The fascia cover 48 can then be placed over the reinforcing clips 60 and the rubber membrane and pushed downwardly until the lip 54 of the lower edge 52 of the fascia cover 48 extends under and engages the lower edge 36 of the gravel dam. In a preferred form of the invention, the lip is crimped then, as shown in phantom in FIG. 4, at intervals along the length of the gravel dam to prevent removal of the fascia cover 48.

In a preferred form of the invention the reinforcing clips 60 are comprised of material which is sufficiently rigid that that material will not be subtantially deformed by tensile forces on the rubber membrane. Because of the provision of the reinforcing clips, the fascia cover 48 need not be capable of resisting high tensile forces on the membrane and can be comprised of a ligher material than would otherwise be necessary. The provision of a light weight fascia cover has a number of advantages. The fascia cover is easier to handle and to position on the gravel dam. If the fascia cover is comprised of a relatively light weight less rigid materials, such as aluminum, crimping of the lip of the lower edge of the fascia is also easier than it would be otherwise if the fascia was comprised of a stiffer or more rigid steel. Additionally, the fascia cover can be comprised of less expensive material and fabrication or manufacturing expenses for forming the fascia cover are reduced.

While in the illustrated arrangement the reinforcing clips 60 are shown as being separable from the fascia cover 48, and have been described as being clipped in place prior to positioning of the fascia cover over the membrane, in other embodiments the reinforcing clips 60 can be fixed in place in the fascia cover 48 in spaced relation along the length of the fascia cover.

Various features of the invention are set forth in the following claims.

I claim:

1. A roof fascia assembly for providing a dam at the edge of a roof and for securing the edge of a rubber membrane overlying the roof in place, the roof fascia assembly comprising:

a dam adapted to be secured to the edge of the roof, the dam including a first portion having a lower edge adapted to be secured to the upper surface of the roof and a vertical portion secured to the vertical surface of the edge of the roof, a lower edge of the vertical portion being below the surface of the roof and an upper portion of the dam projecting above the surface of the roof, and the dam being adapted to support an edge of the membrane thereon, the edge of the membrane extending over the dam and being positioned against an outer surface of the dam;

a fascia for covering at least a portion of the dam and a portion of the rubber membrane, the fascia including a vertical portion adapted to overlie the vertical portion of the dam with the edge portion of the rubber membrane positioned between the vertical portion of the dam and the vertical portion of the fascia, the vertical portion of the fascia having a lower edge including means for engaging the lower edge of the vertical portion of the dam to restrain the fascia against upward movement with respect to the dam, an upper portion extending over the upper portion of the dam, the upper portion of the fascia including a curved lower surface; and a reinforcing clip adapted to be housed within the upper portion of the fascia and providing means for reinforcing the upper portion of the fascia against deflection caused by forces on the rubber membrane, the reinforcing clip including a curved upper surface complementary in shape to the curved lower surface of the upper portion of the fascia and engaging the curved lower surface in face-to-face mating relation whereby the reinforcing clip is housed in nested relation in said upper portion of fascia extending over the upper portion of the dam.

2. A roof fascia assembly as set forth in claim 1 wherein the reinforcing clip includes a first planar portion extending downwardly from the curved portion and adapted to be positioned between the vertical portion of the fascia and the rubber membrane.

3. A roof fascia assembly as set forth in claim 1 wherein a plurality of reinforcing clips housed within the upper portion of the fascia are spaced apart along the length of the fascia.

4. A roof fascia assembly as set forth in claim 1 wherein the first portion of the dam is inclined upwardly from the roof surface to the upper portion of the dam and wherein the upper portion of the fascia extending over the upper portion of the dam includes a curled lower edge adjacent the upper portion of the dam and spaced from the roof surface, the curled lower edge of the fascia defining a smooth curve upwardly and outwardly away from the first portion of the dam.

5. A roof fascia assembly as set forth in claim 4 wherein the reinforcing clip includes a portion having a curled lower edge in nested relation with the curled lower edge of the fascia.

6. A roof fascia assembly as set forth in claim 1 wherein the reinforcing clip is comprised of a piece of metal curved so as to have a configuration wherein the reinforcing clip can nest inside the upper portion of the fascia to provide increased thickness of material in portions of the fascia.

7. A roof fascia assembly as set forth in claim 6 wherein the reinforcing clip includes a first planar portion adapted to be positioned between an upper portion of the vertical portion of the fascia and a portion of the membrane extending over an upper portion of the dam.

8. A roof fascia assembly for providing a dam at the edge of a roof and for securing the edge of a rubber membrane overlying the roof in place, the roof fascia assembly comprising:

a dam adapted to be secured to the edge of the roof, the dam including a first portion having a lower edge adapted to be secured to the upper surface of the roof and a second portion secured to the vertical surface of the edge of the roof, an upper portion of the dam portion projecting above the surface of the roof, and the dam being adapted to support an edge of the membrane thereon, the edge of the membrane extending over the dam;

a fascia for covering at least a portion of the dam and a portion of the rubber membrane, the fascia including a first portion adapted to cover the second portion of the dam with the edge portion of the rubber membrane positioned between the dam and the fascia, an upper portion extending over the upper portion of the dam, the upper portion of the fascia including a curved lower surface; and a plurality of reinforcing clips housed within the upper portion of the fascia in spaced apart relation and providing means for reinforcing the upper portion of the fascia against deflection caused by forces on the rubber membrane, the reinforcing clips each including a curved upper surface complementary in shape to the curved lower surface of the fascia and engaging the curved lower surface in face-to-face mating relation whereby the reinforcing clip is housed in nested relation in the upper portion of the fascia.

9. A roof fascia assembly as set forth in claim 8 wherein the first portion of the dam is inclined upwardly from the roof surface to the upper portion of the dam and wherein the upper portion of the fascia extending over the upper portion of the dam includes a curled lower edge adjacent the upper portion of the dam and spaced from the roof surface, the curled lower edge of the fascia defining a smooth curve upwardly and outwardly away from the first portion of the dam.

10. A roof fascia assembly as set forth in claim 9 wherein the reinforcing clip includes a portion having a curled lower edge in nested relation with the curled lower edge of the fascia.

* * * * *